US006394553B1

(12) United States Patent
McAllister et al.

(10) Patent No.: US 6,394,553 B1
(45) Date of Patent: May 28, 2002

(54) ADJUSTABLE ARMREST ASSEMBLY WITH SINGLE ADJUSTMENT LEVER

(75) Inventors: Michael L. McAllister, Harleysville; Gregory P. Allison, Orefield, both of PA (US); Harald Wurl, Kleinsendelbach (DE)

(73) Assignee: Knoll, Inc., East Greenville, PA (US)

( * ) Notice: Subject to any disclaimer, the term of this patent is extended or adjusted under 35 U.S.C. 154(b) by 0 days.

(21) Appl. No.: 09/591,680

(22) Filed: Jun. 9, 2000

(51) Int. Cl.[7] ..... B60N 2/46; A47C 7/54

(52) U.S. Cl. ..... 297/411.36; 297/411.35; 297/411.38; 297/411.37

(58) Field of Search ..... 297/411.35, 411.36, 297/411.37, 411.38

(56) References Cited

U.S. PATENT DOCUMENTS

| | | | |
|---|---|---|---|
| 455,168 | A | 6/1891 | Case |
| 2,235,292 | A | 3/1941 | Glynn |
| 2,325,292 | A | 7/1943 | Westrope |
| 3,142,194 | A | 7/1964 | Garden |
| 3,474,993 | A | 10/1969 | Murcott |
| 3,747,976 | A | 7/1973 | Lacey |
| 3,950,027 | A | 4/1976 | Wilson |
| 4,036,525 | A | 7/1977 | Howk |
| 4,153,296 | A | 5/1979 | Rhamstine |
| 4,267,748 | A | 5/1981 | Grunewald et al. |
| 4,401,006 | A | 8/1983 | Sekiguchi |
| 4,456,298 | A | 6/1984 | Gottstein |
| 4,546,668 | A | 10/1985 | Mattsson |
| 4,659,135 | A | 4/1987 | Johnson |
| 4,660,885 | A | 4/1987 | Suhr et al. |
| 4,674,790 | A | 6/1987 | Johnson |
| 4,828,323 | A | 5/1989 | Brodersen et al. |
| 4,951,995 | A | 8/1990 | Teppo et al. |
| 4,961,610 | A | 10/1990 | Reeder et al. |
| 5,050,933 | A | 9/1991 | Tornero et al. |
| 5,056,863 | A | 10/1991 | DeKraker et al. |
| 5,143,422 | A | 9/1992 | Althofer et al. |
| 5,265,938 | A | 11/1993 | Melhuish et al. |
| 5,318,347 | A | 6/1994 | Tseng |
| 5,324,096 | A | 6/1994 | Schultz |
| 5,338,133 | A | 8/1994 | Tornero |
| 5,346,284 | A | 9/1994 | Dauphin |
| 5,368,365 | A | 11/1994 | Feldberg |
| 5,382,079 | A | 1/1995 | Wilson et al. |
| 5,393,124 | A | 2/1995 | Neil |
| 5,393,125 | A | 2/1995 | Watson et al. |
| 5,439,267 | A | 8/1995 | Peterson et al. |
| 5,462,338 | A | 10/1995 | Baumann |
| 5,484,187 | A | 1/1996 | Doerner et al. |
| 5,599,067 | A | 2/1997 | Schuelke et al. |
| 5,641,203 | A | 6/1997 | Van De Riet et al. |
| 5,647,638 | A | 7/1997 | Ritt et al. |
| 5,655,814 | A | 8/1997 | Gibbs |
| 5,660,442 | A | 8/1997 | Tornero |
| 5,667,277 | A | 9/1997 | Van De Riet |
| 5,746,480 | A | 5/1998 | Bonutti |
| 5,752,683 | A | 5/1998 | Novis et al. |
| D398,174 | S | 9/1998 | Fahnstrom et al. |
| 5,829,839 | A | 11/1998 | Wilkerson et al. |
| 5,853,223 | A | 12/1998 | Ritt et al. |
| 5,921,630 | A | 7/1999 | Cassaday |
| D423,241 | S | 4/2000 | Magnusson et al. |
| 6,053,578 | A | 4/2000 | van Hekken et al. |

*Primary Examiner*—Carl D. Friedman
*Assistant Examiner*—Dennis L. Dorsey
(74) *Attorney, Agent, or Firm*—Buchanan Ingersoll

(57) ABSTRACT

An armrest assembly for a chair which can be adjusted in multiple aspects with the use of single actuating mechanism. The adjustment aspects of the preferred embodiment include a vertical adjustment with respect to the chair and a horizontal rotational adjustment. Such an armrest assembly can include an armrest base securable to a chair and having a tubular portion, a hollow armrest support slideably and rotationally disposed about the tubular portion and an armpad attached to the top of the hollow armrest support. A handle to disengage the actuating mechanism is provided.

13 Claims, 14 Drawing Sheets

ADJUSTABLE ARMREST ASSEMBLY WITH SINGLE ADJUSTMENT LEVER

BACKGROUND OF THE INVENTION

The present invention relates generally to armrests for chairs and more particularly, to an armrest assembly which is adjustable in a plurality of aspects.

A wide variety of adjustable office chairs are presently available. In an attempt to adapt the chair to a particular user or task, various adjustment mechanisms have been provided. Such chairs may, for example, include vertically adjustable seat height mechanisms, swivel tilt mechanisms, and adjustable back height mechanisms. Additionally, such chairs may be provided with adjustable armrest assemblies. Many such chairs have been provided which have an adjustable height armrest, such as those described in U.S. Pat. No. 5,393,125 to Watson, et al. Other such chairs have armrests which can be adjustable laterally to effect the spacing between the armrests, or armrests which can be rotated in towards the user or out away from the user. It is also known for an armrest to provide adjustments in multiple aspects, such as his disclosed in U.S. Pat. No. 5,439,267 to Peterson, et al., which discloses an armrest assembly wherein the armrest can be adjusted vertically and an armpad portion of the armrest can be moved laterally, and U.S. Pat. No. 6,053,578 to van Hekken, et al, which discloses an armrest which can be adjusted laterally, vertically, forwards and backwards and rotationally. The van Hekken, et al. patent is owned by the assignee of this application.

One concern with armrests which are adjustable in multiple aspects is that each such adjustment requires the user to initiate adjustment in each aspect using different adjustment mechanisms. This can be cumbersome for the user in that an adjustment in one aspect may affect the desired adjustment in another aspect, requiring multiple adjustments for each aspect until a comfortable position is achieved. Therefore, a need exists for an armrest providing a single mechanism which controls the adjustment of two or more aspects of the armrest, thereby allowing two or more aspects to be adjusted at the same time.

SUMMARY OF THE INVENTION

The present invention is directed to an armrest assembly securable to a chair and simultaneously adjustable in two or more aspects with a single adjustment mechanism. Specifically, the armrest assembly disclosed herein provides for vertical height adjustment and rotational positioning using a single adjustment mechanism which is easily accessible to the user when the user's arm is in a resting position on the armrest.

The armrest assembly having features of the present invention described above includes a base having a means for attaching the armrest to the underside of the seat of a chair or to the frame of a chair. The base is connected to a tubular vertical post. The vertical post has an array of recesses aligned in rows and columns on one side thereof. A shroud is slideably and rotatably disposed on the vertical post. The shroud houses a locking mechanism consisting of a bar having a plurality of pins inserted therethrough which engage the recesses defined on the tubular vertical post, thereby locking the armrest in place. The pins are locked in place and released by a second bar which slides up and down adjacent to the first bar. The second bar has indentations defined therein to allow the pins to be disengaged from the recesses when the portion of the second bar having the indentations is positioned over the pins. An armpad portion is attached to the top of the slideable shroud portion. When a handle connected to the second bar is engaged by the user, the plurality of pins are disengaged from the recesses on the post, thereby allowing the shroud and armpad portions of the armrest to be adjusted vertically and rotated about a point approximately in the center of the armrest. When the desired position has been achieved, the user disengages the handle, thereby allowing the pins to engage the corresponding recesses on the tubular vertical post nearest the selected position, locking the armrest into position with respect to the post.

Other details, objects and advantages of the inventions will become apparent from the following detailed description and accompanying drawings of the present preferred embodiments thereof.

DETAILED DESCRIPTION

Figure 1:
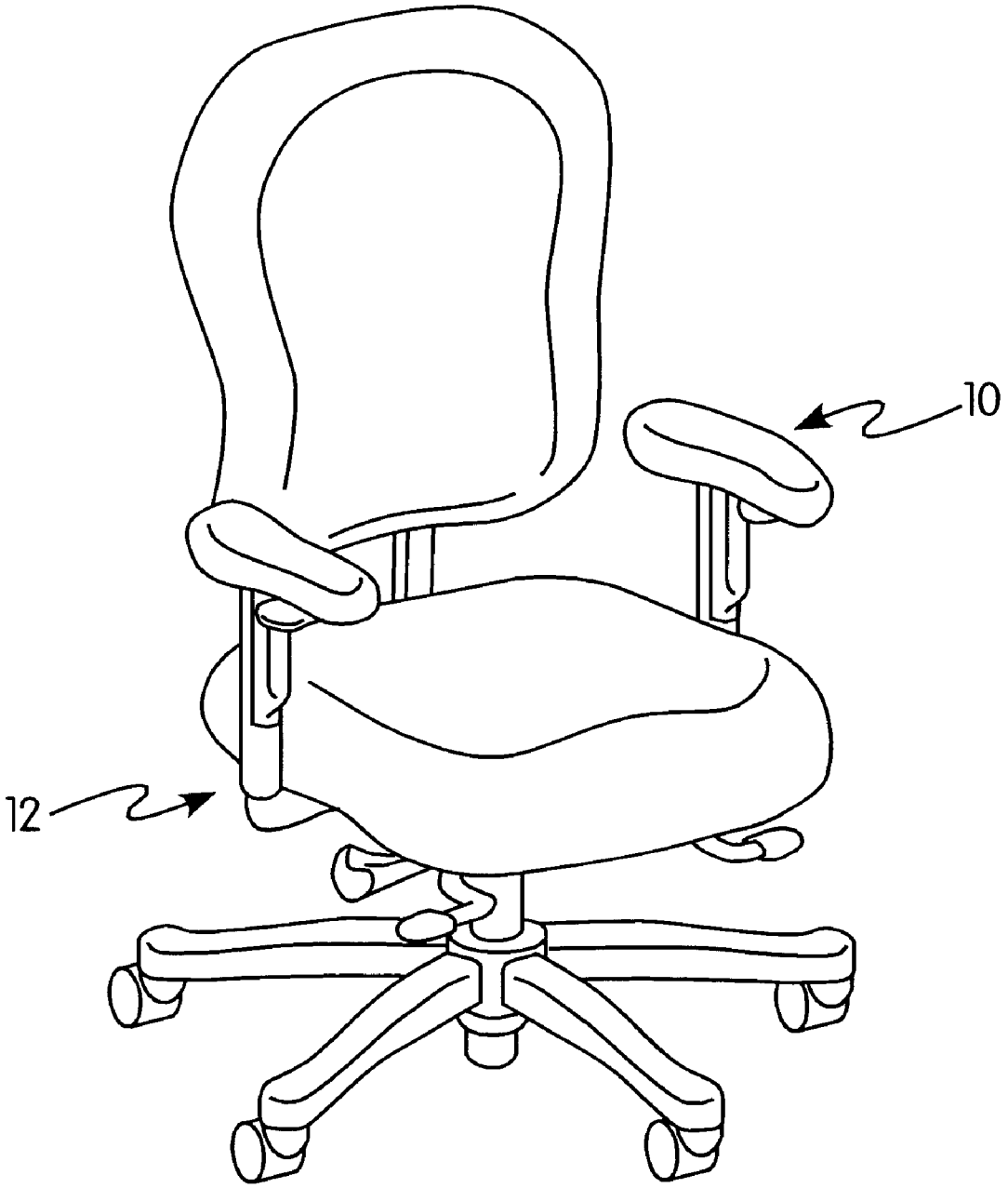
FIG. 1 shows a chair with the armrest assembly of the current invention attached thereto.
Figure 2:
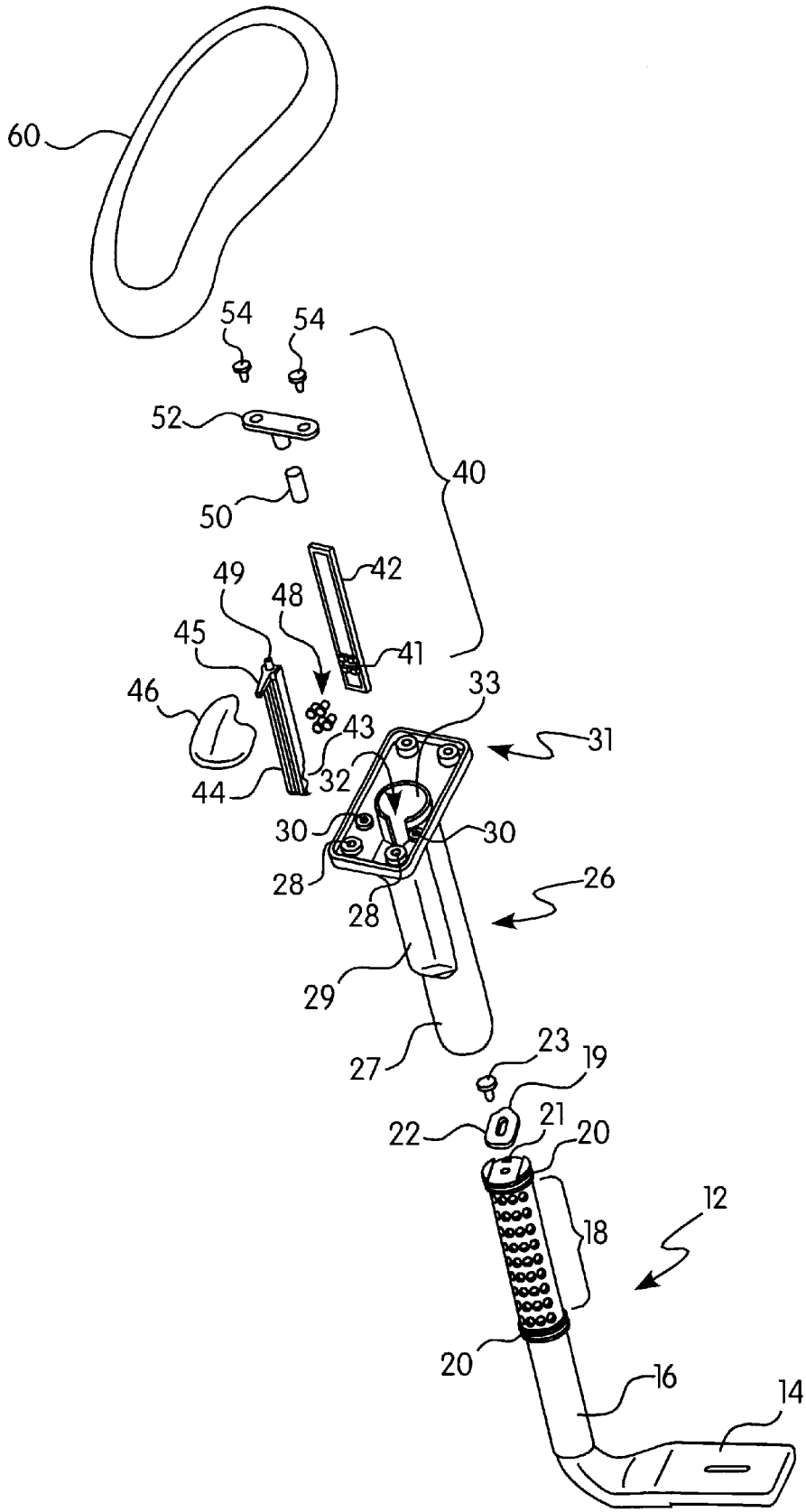
FIG. 2 shows an exploded detailed view of the armrest assembly of the current invention.
Figure 2A:
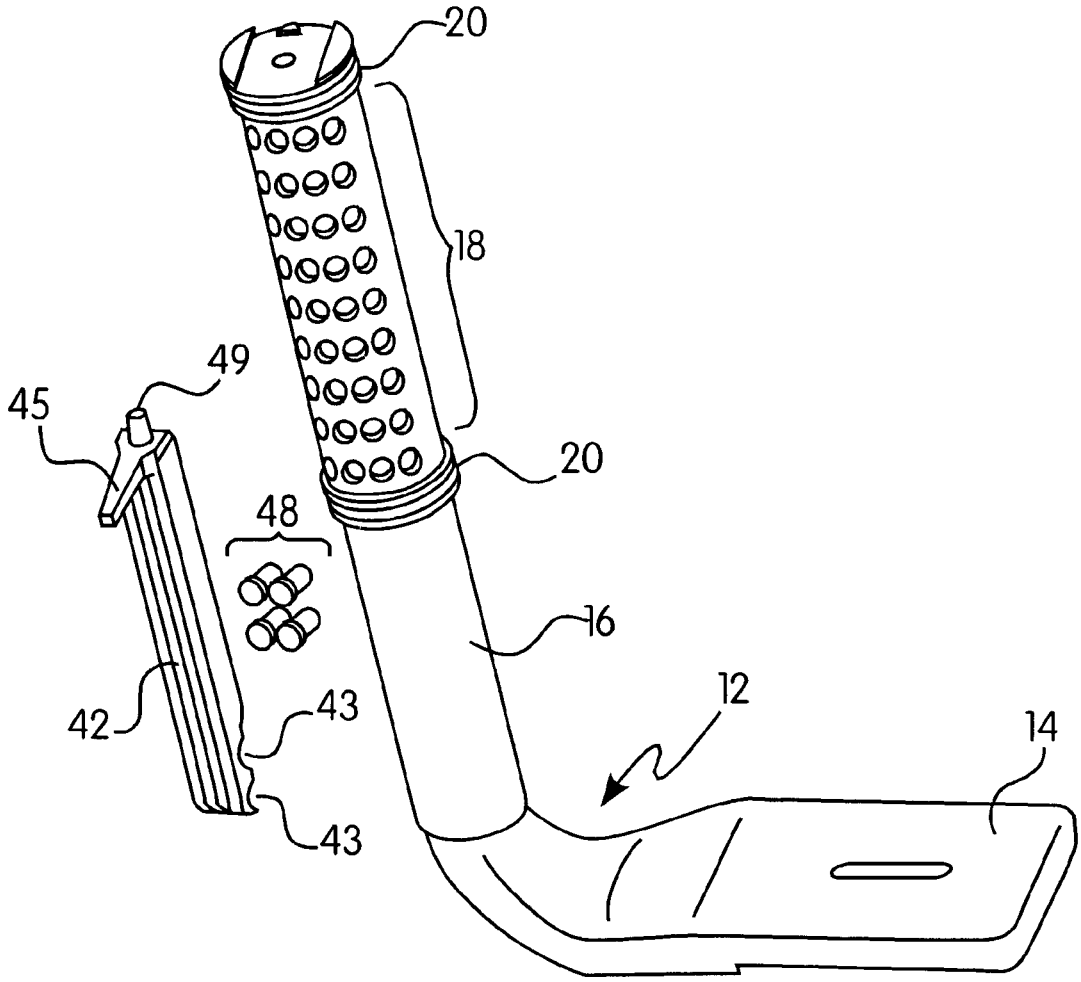
FIG. 2*a* shows an exploded view of the locking mechanism of the current invention.
Figure 2B:
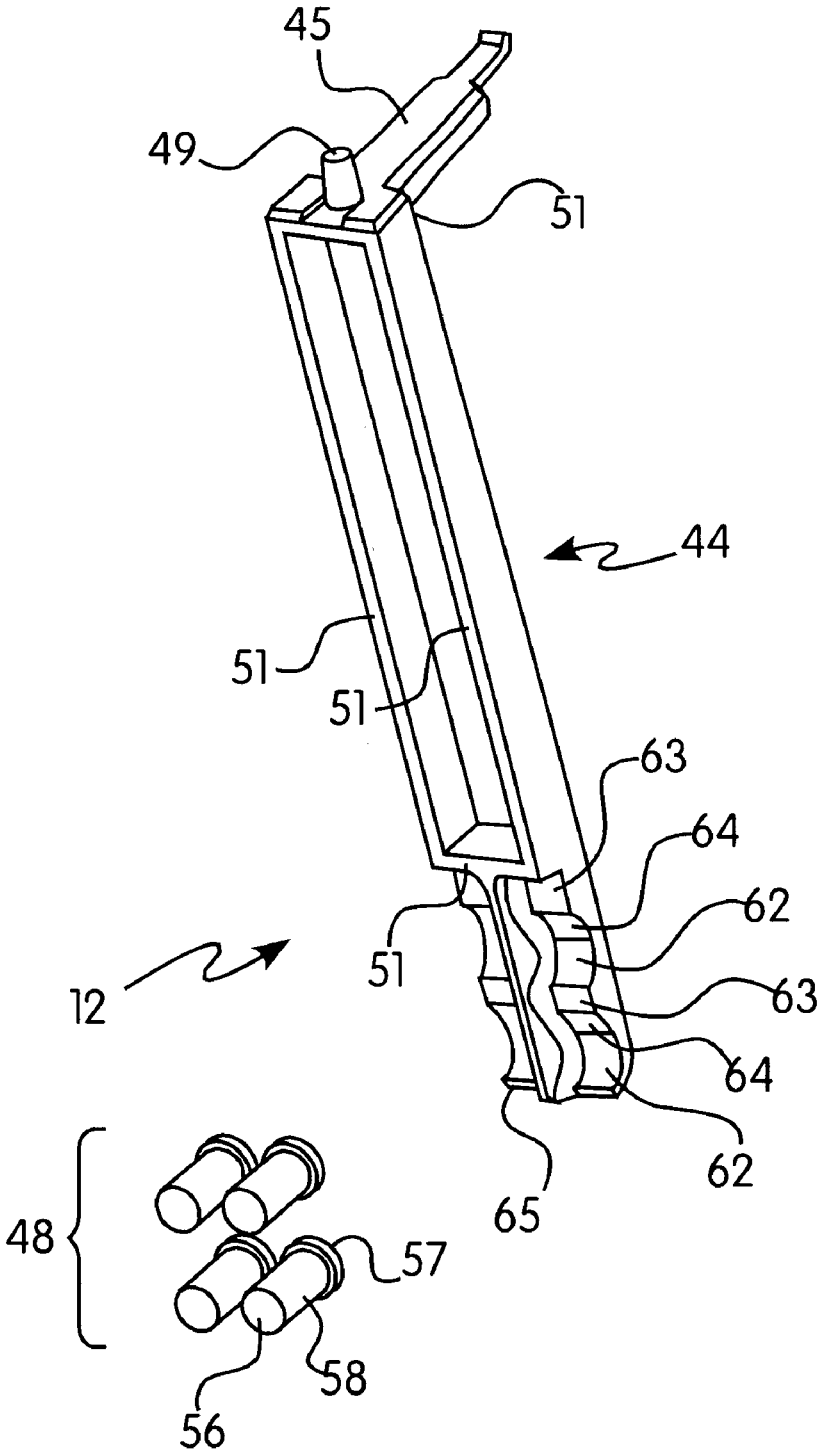
FIG. 2*b* shows an enlargement of the locking bar and pins of the locking mechanism of FIG. 2*a* rotated 180 degrees for clarity.

Referring now to the various figures, where like reference numbers refer to similar parts throughout the several views, FIG. 1 shows a pair of armrests 10 of the current invention attached to a chair. FIGS. 2, 2*a* and 2*b* show exploded and detailed views of the preferred embodiment of the current invention. The armrest assembly consists generally of base 12 comprising an attachment member 14 configured to be connected to the base or frame of a chair with a securing mechanism (not shown). Connected to attachment member 14, and generally formed as one piece with attachment member 14 is vertical member or post 16, which in the preferred embodiment is tubular in shape, although any shape could be used. Defined on post 16 is a plurality of recesses 18, which in the preferred embodiment, are concave in shape and arranged in rows and columns. In the preferred embodiment, there are thirty-six recesses 18, arranged in nine rows of four recesses each, however, any number of rows and columns of recesses 18 may be utilized.

Figure 3:
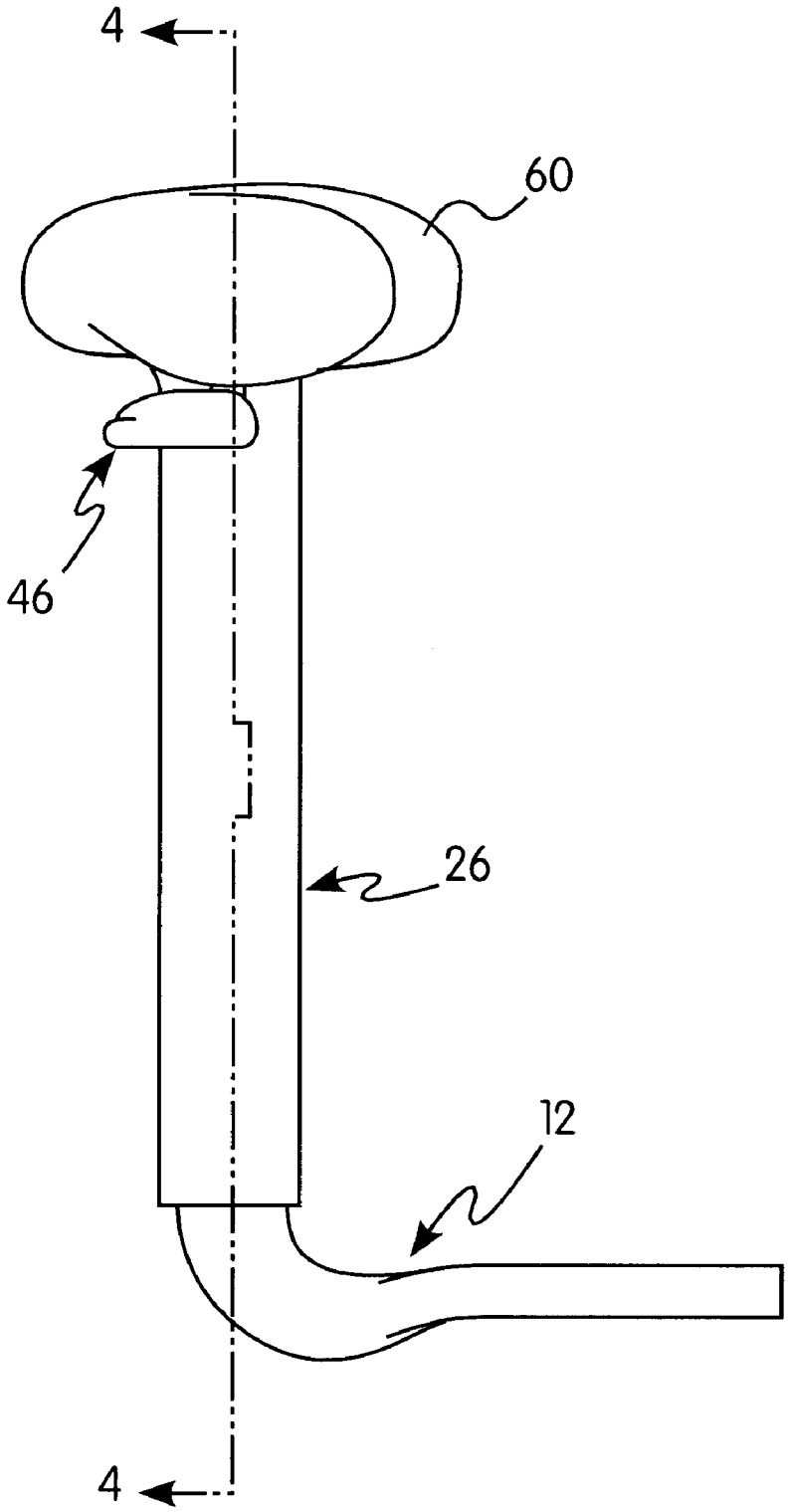
FIG. 3 shows a front elevational view of the armrest in a lowered position.
Figure 5:
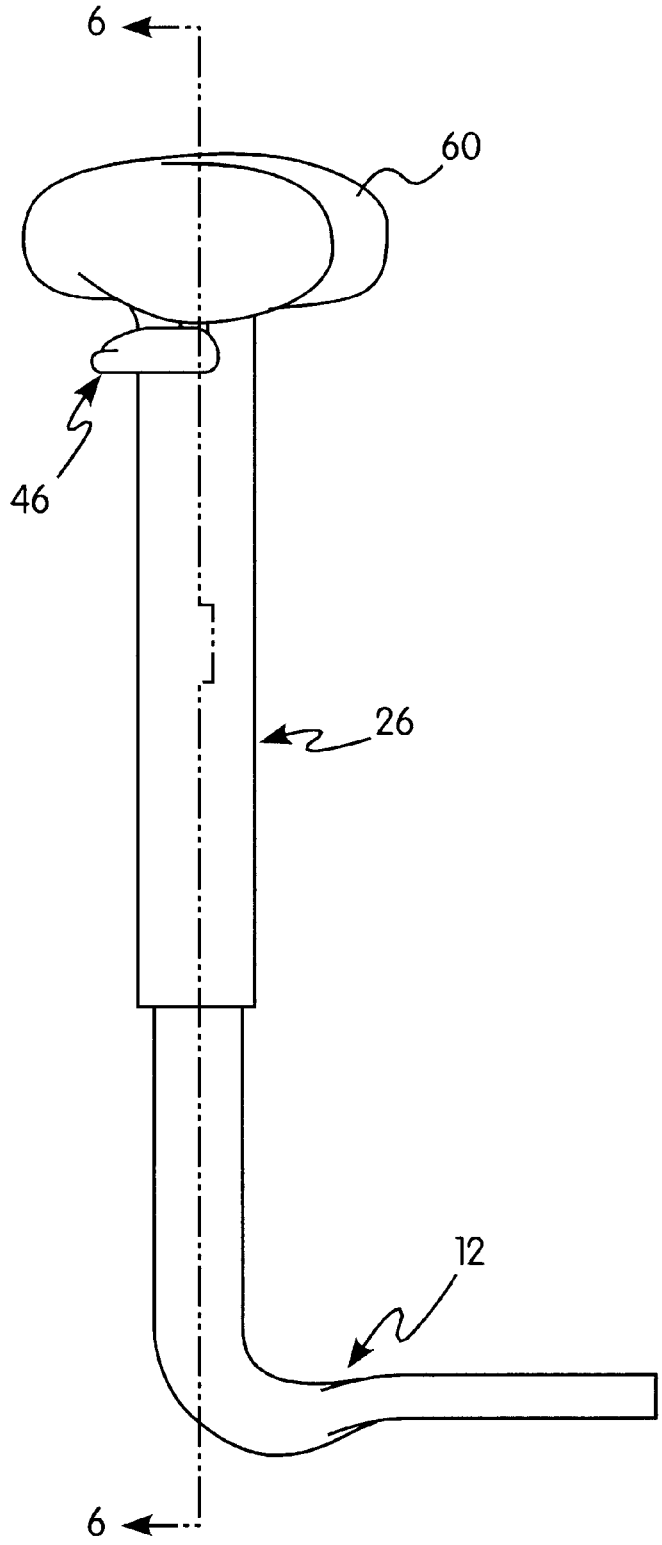
FIG. 5 shows a front elevational view of the armrest assembly of the current invention in an extended position.
Figure 7:
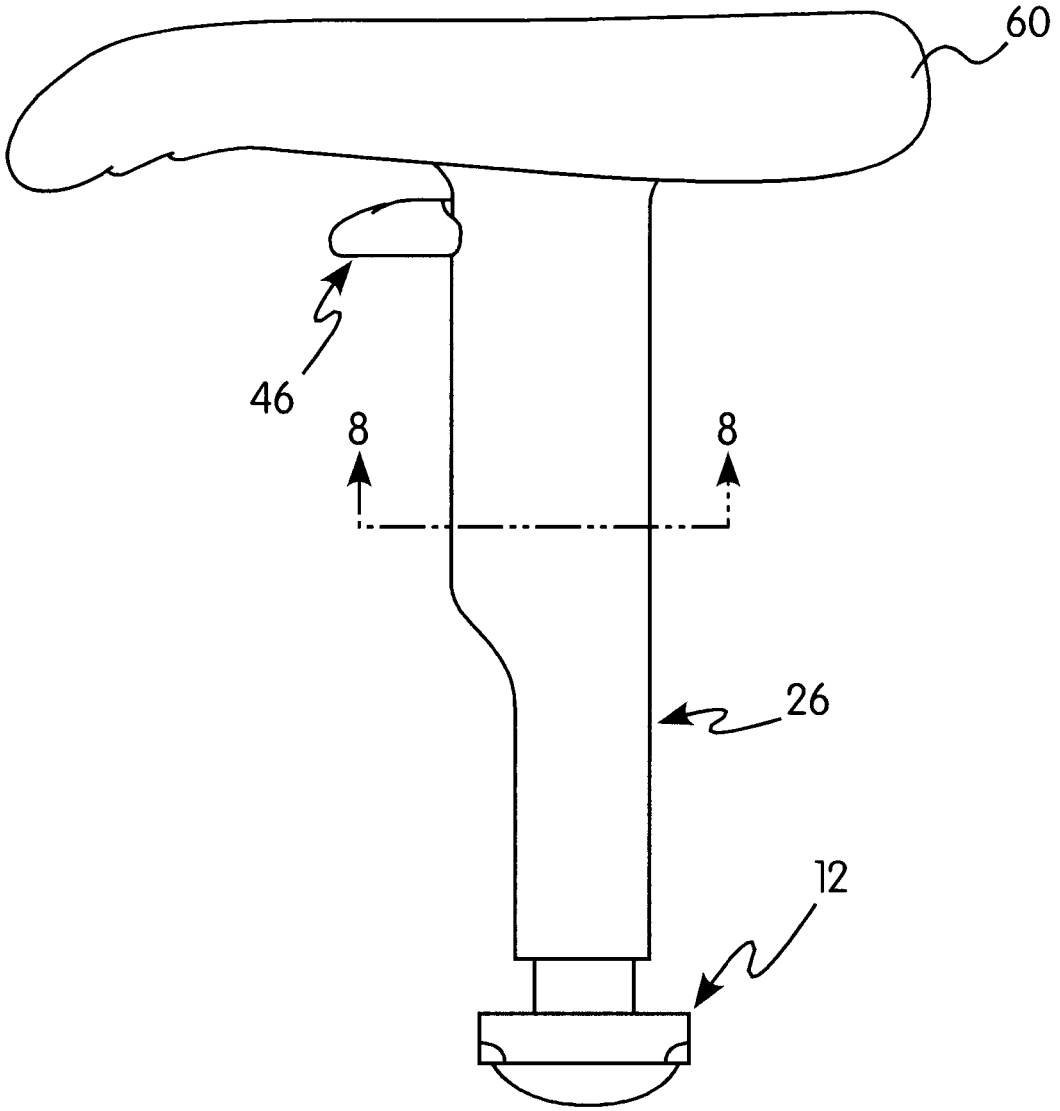
FIG. 7 shows a right side elevational view of the armrest assembly of the current invention.
Figure 9:
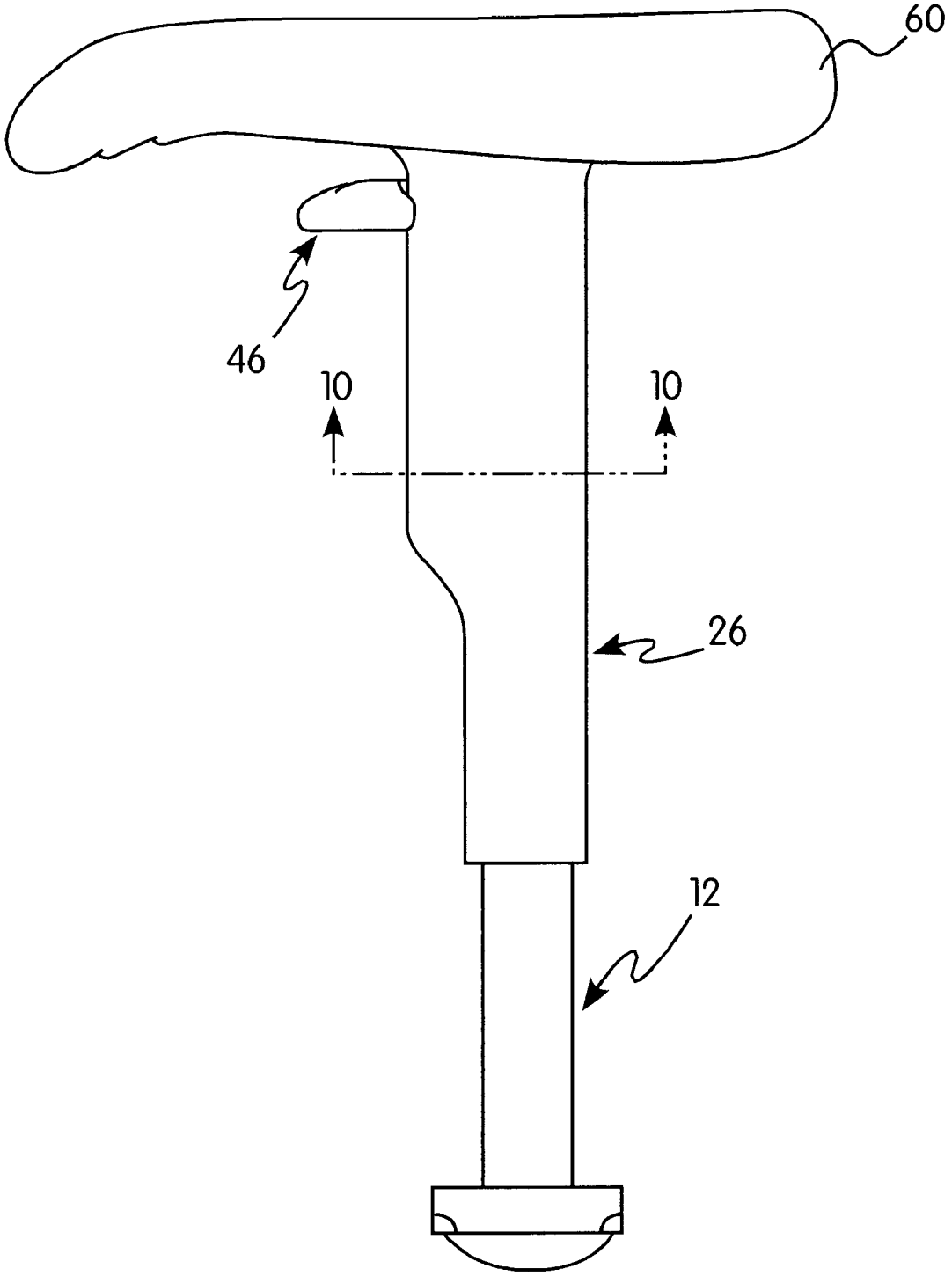
FIG. 9 shows a right side elevational view of the armrest assembly of the current invention in the extended position.
Figure 11:
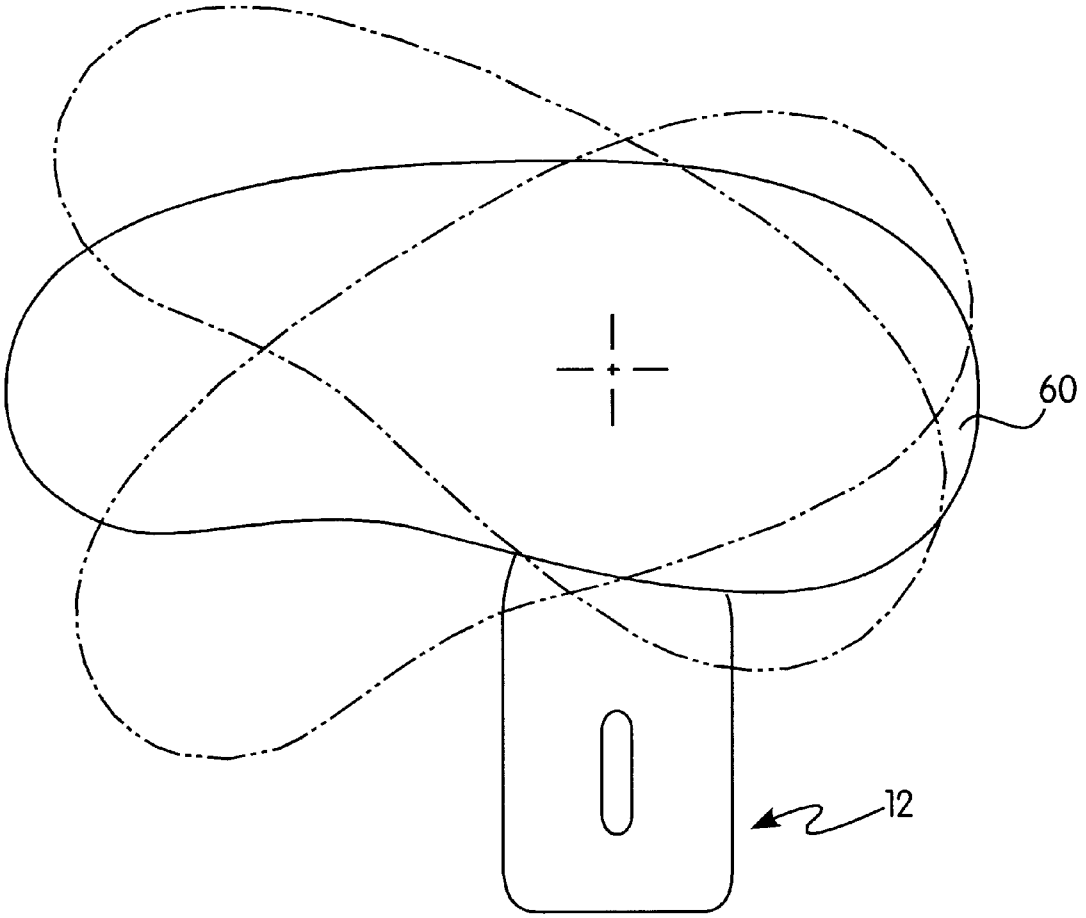
FIG. 11 shows a top view of the armrest assembly of the current invention illustrating in phantom lines, the rotational limits of the armpad.

The moveable portion 26 of the armrest assembly comprises a generally cylindrical hollow shroud member 27 topped by member 31. Armpad 60 is secured to the top of shroud member 27 via a plurality of screws (not shown) which extend up through holes 28 in member 31. Defined on one side of shroud member 27 is housing 29 which houses locking mechanism 40. Hollow area 32 defined by shroud member 27 accepts post 16 of base 12, allowing moveable portion 26 to move vertically and rotate laterally with respect to base 12. Post 16 has bearings 20, disposed in grooves defined therein to aid in the tightness of fit of movable portion 26. Defined on the interior diameter of hollow 32 is groove 33, which is preferably rectangular in shape. Stop member 22, connected to the top of post 16 by screw 23, defines tongue 19 thereon. Tongue 19 engages groove 33 to limit the rotational and vertical movement of moveable portion 26 with respect to base 12. In addition, the orientation of stop member 22 controls the amount of rotation of armrest 10. By orienting member 22 180 degrees to that shown in FIG. 2, all rotation of the armrest 10 can be eliminated. Likewise, by orienting member 22 only 90 degrees, or by changing the thickness of tongue 19, the degree or limits of rotation of armrest 10 can be altered. An example of the possible range of rotational motion available to movable portion 26 is shown in FIG. 11, and an example of the range of vertical movement is shown by comparing FIGS. 3 and 7 with FIGS. 5 and 9. Note that these figures are in no way meant to limit the scope of the invention to the ranges of movement shown therein.

Locking mechanism 40 comprises bar 42, which may be rectangular in shape, best shown in FIG. 2. Bar 42 defines a plurality of holes 41 located, in the preferred embodiment, at the bottom portion of bar 42. A corresponding plurality of pins 48 are slideably disposed within holes 41. Bar 42 is preferably composed of glass-reinforced nylon and is made as a single piece using an injection molding process well known to those of ordinary skill in the art.

Pins 48, which are slideably disposed in holes 41 defined in bar 42, are shaped having top member 57 slightly larger than body member 58 such that the pins cannot extend completely through holes 41. Additionally, pins 48 preferably have a convex end 56 opposite top member 57. Convex end 56 is shaped and sized to mate with recesses 18 defined in post 16. In the preferred embodiment, the number of holes 41 and pins 48 is four, however, any number of holes and pins may be utilized. Preferably, pins 48 are composed of glass-reinforced nylon and are made using an injection molding process. When in place in housing 29, pins 48 engage a corresponding number of recesses 18 to inhibit the movement of movable member 26 with respect to base 12.

Locking bar 44, which is rectangular in shape and complements bar 42 in shape, holds pins 48 in a locked engagement with recesses 18 when in a locked position. Locking bar 44 is preferably one-piece and preferably composed of glass-reinforced nylon and is manufactured using an injection molding process. Toward the lower portion of locking bar 44 are defined a plurality of indentations 43, corresponding to the number of pins 48 which have been utilized. For each pin 48, a corresponding indentation 43 having a deep area 62, a sloped area 64 and a shallow area 63 is utilized. Indentations 43 are divided vertically by divider 65. Features of locking bar 44 are best shown in FIG. 2*b*. Locking bar 44 contacts bar 42 on surfaces 51 and is able to slide along bar 42 to an up, unlocked position, or a down, locked position. Spring 50 biases bar 42 in a down, locked position.

When in an up, unlocked position, indentations 43 in locking bar 44 allow pins 48 to disengage from recesses 18, thereby allowing moveable portion 26 to move simultaneously both vertically and rotationally with respect to base 12. Each of indentations 43 has two flat areas, 62 and 63, sized to accept the top portions 57 of pins 48. The flat areas 62 and 63 of indentations 43 are of differing depths, with area 62 being deeper than area 63. Areas 62 and 63 are connected via sloped area 64. This is best shown in FIG. 2*b* and in cross-section in FIG. 4. Locking bar 44 is able to slide up and down adjacent bar 42 on surfaces 51, allowing indentations 43 to act as a wedge and be positioned over the top portions 57 of pins 48. When bar 44 is in an up, unlocked position, pins 48 are allowed to enter deep area 62 of indentations 43, thereby disengaging from recesses 18 on post 16. As locking bar 44 slides into a down, locked position, sloped area 64 of indentations 43 forces pins 48 into engagement with recess 18 by a wedging-type action. When locking bar 44 is completely in a down position, pins 48 are fully engaged in recesses 18 and are locked in position by shallow area 63 of indentations 43.

Integral to locking bar 44 is boss 49, located on the top thereof and actuator 45, best shown in FIG. 2*b*. Spring 50 is held in place on top of locking bar 44 by boss 49, and on the bottom of header member 52 by a circular depression (not shown). Spring 50 biases locking bar 44 in a down, locked position, thereby causing pins 48 to be pushed through holes 41 in bar 42 to engage recesses 18, as described above.

Header member 52, which is generally T-shaped, is held in place by screws 54 which engage holes 30 in moveable portion 26. Header member 52 holds bar 42, locking bar 44 and spring 50 in place within housing 29. Actuator 45 extends through a hole defined in housing 29 (not shown). Ergonomic handle 46 fits over actuator 45 to allow the user of the chair to manually move locking bar 44 into a unbiased position. When in this unbiased position, pins 48 are pushed into deep area 62 of indentations 43 in bar 44 by any movement of movable member 26 by virtue of the convex/concave mating surface between pins 48 and recesses 18. When pins 48 are in this disengaged position, the entire movable portion 26 of armrest assembly 10 is able to be moved vertically and also rotated, to simultaneously adjust the vertical height and rotational position to armpad 60.

Figure 4:
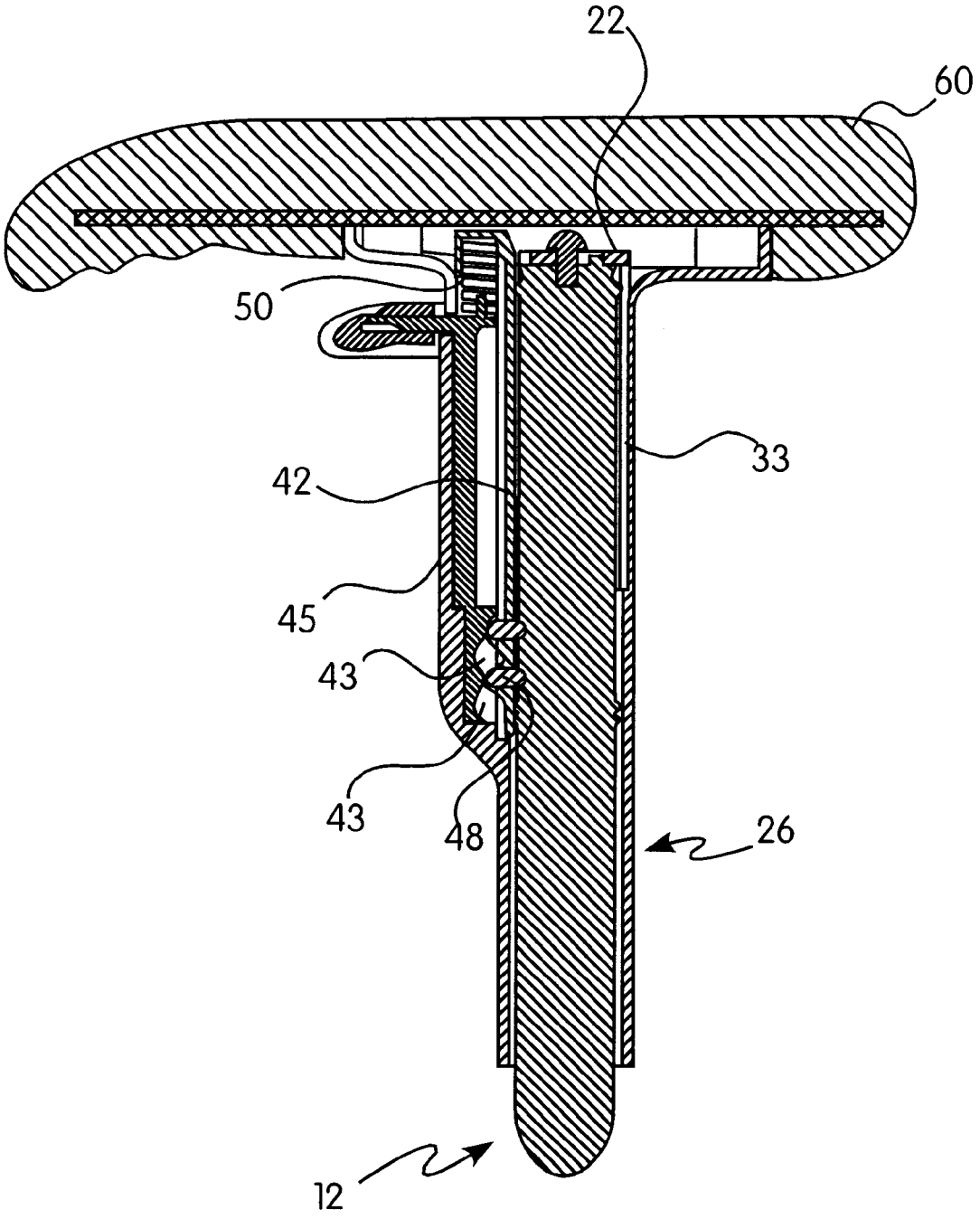
FIG. 4 shows a cross-section of the armrest assembly of FIG. 3 having the locking mechanism engaged.
Figure 4A:
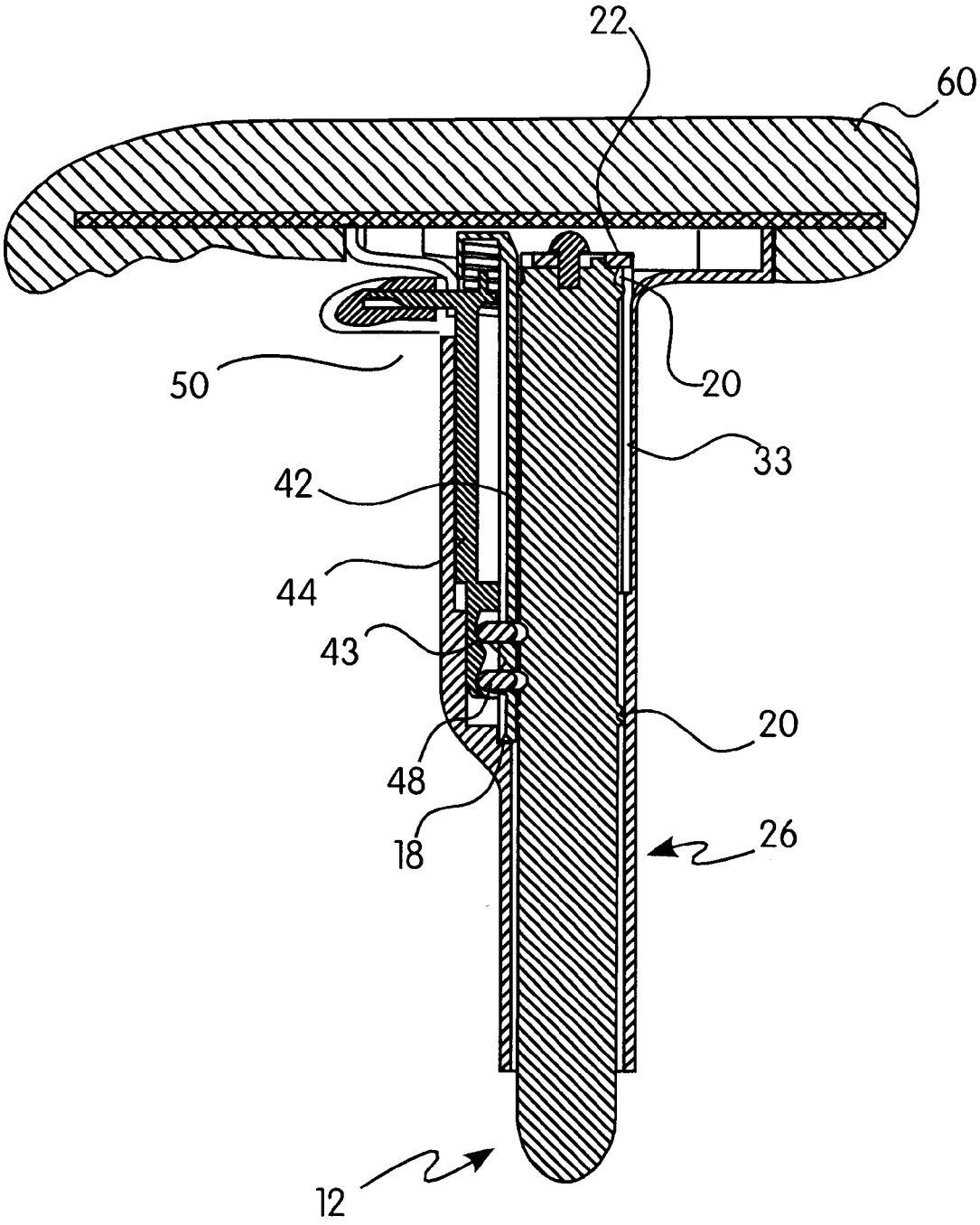
FIG. 4*a* shows a cross-section of the armrest assembly of FIG. 3 having the locking mechanism disengaged.
Figure 6:
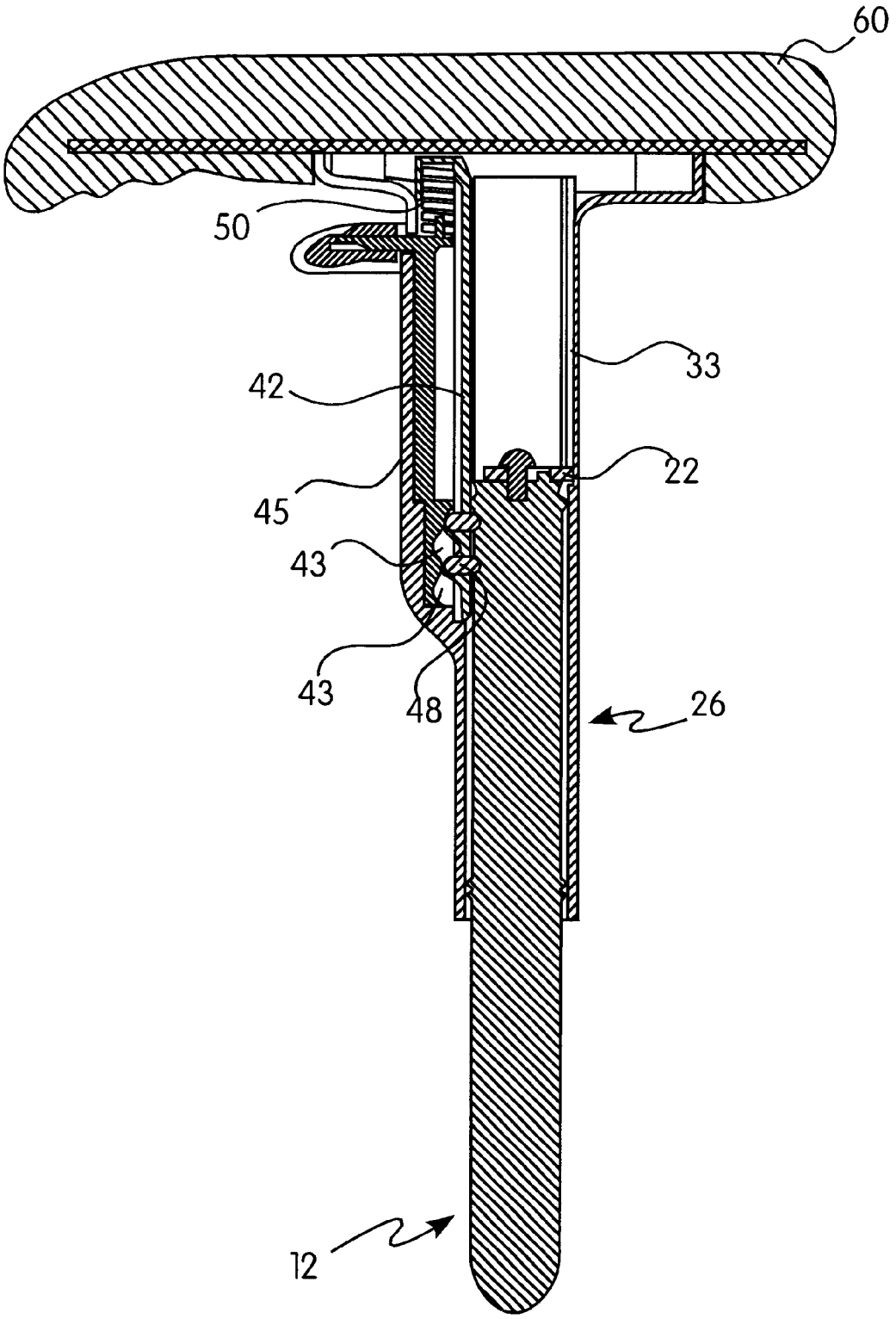
FIG. 6 shows a cross-sectional view of the armrest assembly of FIG. 5 having the locking mechanism engaged.
Figure 8:
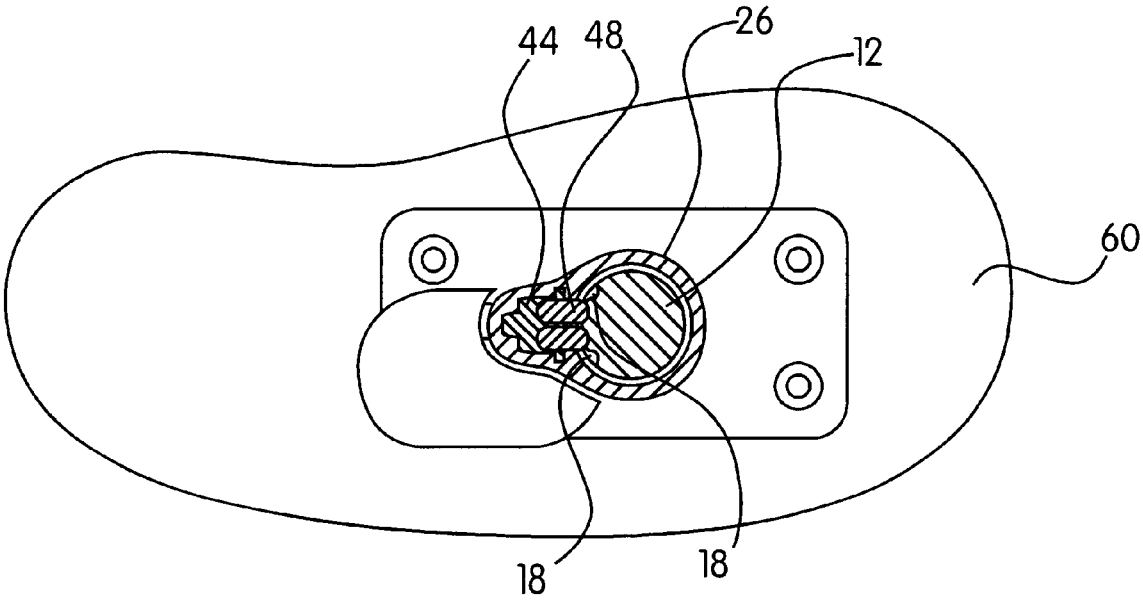
FIG. 8 shows a cross-sectional view of a portion of the armrest assembly of FIG. 7 showing the locking mechanism in an engaged position.
Figure 10:
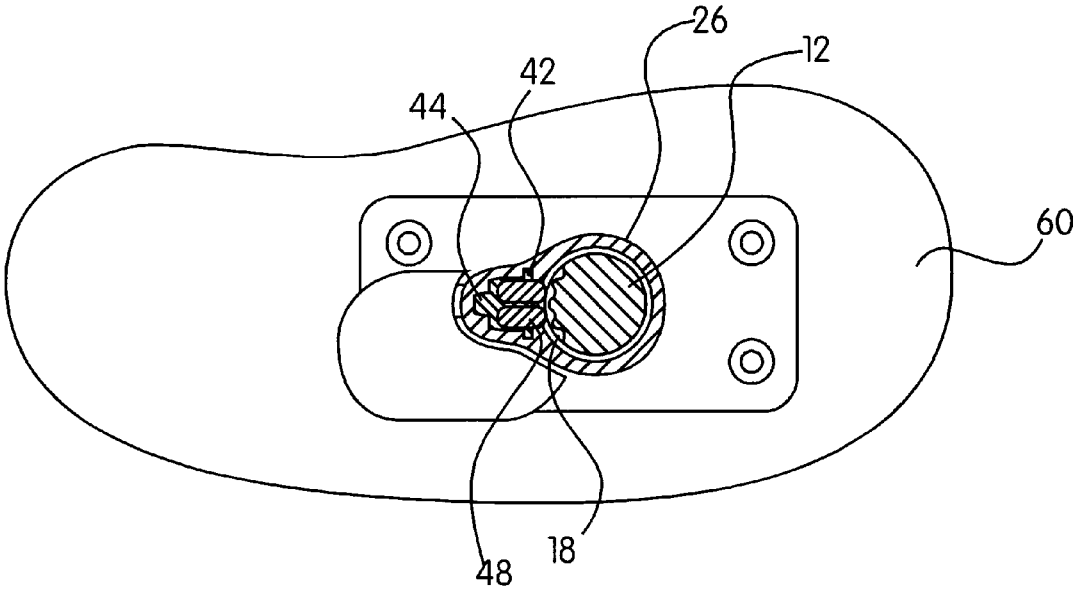
FIG. 10 shows a cross-sectional view of a portion of the armrest assembly of FIG. 9 showing the locking mechanism in a disengaged position.

In an engaged, locking position, as best shown in the cross sectional views of FIGS. 4, 6 and 8, locking bar 44 is biased in a downward position within housing 29 by spring 50, causing shallow area 63 of indentations 43 to push pins 48 securely against bar 42. Convex ends 56 of pins extend through holes 41 in bar 42 and engage a corresponding plurality of recesses 18, depending upon the position of moveable portion 26 chosen by the user. Preferably, there will be a large number of recesses 18, thereby allowing a wide range of possible positions for movable portion 26. When the user wishes to change the vertical or rotational position of armrest 60, actuator 45 with handle 46 is pulled upward. Any movement of moveable portion 26 forces pins 48 into deep area 62 of indentations 43 defined in locking bar 44. This is best illustrated in the cross sectional views of FIGS. 4*a* and 10. With pins 48 no longer engaged with recesses 18 of post 16, moveable portion 26 is free to move vertically and rotationally. When the user is satisfied with the positioning of armpad 60, handle 46 is released and spring 50 biases bar 44 into the down, locked position. Pins 48 are forced through holes 41 by wedging action of sloped areas 64 of indentations 43, and are held in the locked position by the shallow area 63 of indentations 43. Moveable portion 26 may be moved slightly such that pins 48 are able to seek the nearest set of recesses 18 on post 16 corresponding to the selected position. Stop member 22 prevents moveable portion 26 from moving to an area having no recesses 18 defined therein.

While certain embodiments of the invention have been described in detail, it will be appreciated by those skilled in the art that various modifications to those details could be developed in light of the overall teachings of the disclosure. Accordingly, the particular embodiments disclosed herein are intended to be illustrative only and not limiting to the scope of the invention, which should be awarded the full breadth of the following claims and any and all embodiments described thereby.

We claim:

1. An adjustable armrest assembly for a chair comprising:

a first portion capable of being attached to said chair, said first portion comprising:

a horizontal portion connected to said chair; and a vertical tubular portion connected to said horizontal portion, said tubular portion defining a plurality of recesses arranged in rows and columns thereon;

a second portion coupled to said first portion such that said second portion can move simultaneously in two or more aspects with respect to said chair, said second portion comprising a hollow, generally cylindrical portion slideably and rotationally disposed about said vertical tubular portion of said first portion; and a locking mechanism to hold said second portion in a locked relationship with said first portion, said locking mechanism comprising:

a first bar disposed within said hollow cylindrical portion, adjacent said vertical tubular portion, said first bar having a plurality of holes defined therein, such that said plurality of holes overlaps said plurality of recesses;

a plurality of pins, slideably disposed within said plurality of holes defined in said first bar, such that said pins can engage a portion of said plurality of recesses; and a second bar, slideably disposed adjacent said first bar, said second bar slideable between two positions;

wherein said second bar, when in said first position, locks said plurality of pins in engaging contact with a portion of said plurality of recesses, and wherein said second bar, when in said second position, allows said plurality of pins to disengage from said portion of said plurality of recesses.

2. The adjustable armrest assembly of claim 1 wherein said two or more aspects of motion comprise:

a vertical motion with respect to said chair; and a horizontal rotational motion.

3. The armrest assembly of claim 1 further comprising:

an armpad cushion portion; and wherein said second portion further comprises:

a receiving portion, connected to said hollow cylindrical portion, to which said armpad portion is attached.

4. The armrest assembly of claim 1 wherein said second bar defines a plurality of indentations corresponding to said plurality of pins, wherein said pins can disengage from said plurality of recesses and slide into said plurality in indentations when said second bar is in said second position.

5. The armrest assembly of claim 1 wherein said locking mechanism further comprises:

a spring, biasing said second bar in said first position; and an actuator, connected to said second bar, allowing a user of said chair to move said bar from said first position to said second position.

6. The armrest assembly of claim 5 wherein said actuator extends through a hole defined in said hollow cylindrical position, to allow said user to move said second bar.

7. The arm rest assembly of claim 1, wherein said user may move said second portion vertically with respect to said chair and may simultaneously rotate said second portion horizontally when said second bar is moved to said second position.

8. The arm rest assembly of claim 1, wherein said cylindrical hollow portion defines a groove on the interior diameter thereof and further comprising:

a stop portion connected to said tubular portion;

a tongue portion, connected to said stop portion, said tongue portion extending into said groove;

wherein said rotational and vertical motion of said second portion is limited when said tongue contacts the outermost limits of said groove.

9. The armrest assembly of claim 8 wherein said groove is rectangular in shape.

10. An armrest assembly for a chair comprising:

a horizontal member capable of being attached to said chair;

a post, connected to said horizontal member;

a hollow member slideably engaged with said post, such that said hollow member can simultaneously move vertically and rotationally with respect to said post; and a locking mechanism to hold said hollow member in a locked relationship with said first portion, said locking mechanism comprising:

a plurality of recesses defined on said post, a plurality of pins for engaging said plurality of recesses; and means for holding said pins in an engaged relationship with said recesses.

11. The armrest assembly of claim 10 further comprising a spring to bias said locking mechanism to maintain said locked relationship between said hollow member and said post.

12. The armrest assembly of claim 11 further comprising an actuator, connected to said locking mechanism, for manually disengaging said locking mechanism, thereby allowing simultaneous vertical and rotational movement of said hollow member with respect to said post.

13. The armrest assembly of claim 10 wherein said means for holding comprises:

a bar, having a plurality of indentations defined therein, said bar slideably disposed adjacent said post and slideable between two positions;

wherein said bar, when in said first position, covers said pins and holds said pins in engaging contact with said recesses; and wherein said bar, when in said second position, allows said plurality of pins to move into said indentations, thereby disengaging said pins from said portion of said plurality of recesses.

* * * * *